US007450076B1

(12) United States Patent
Lin et al.

(10) Patent No.: US 7,450,076 B1
(45) Date of Patent: Nov. 11, 2008

(54) INTEGRATED MULTI-BAND ANTENNA

(75) Inventors: Ching-Chi Lin, Taipei Hsien (TW); Kai Shih, Taipei Hsien (TW); Yu-Yuan Wu, Taipei Hsien (TW); Jia-Hung Su, Taipei Hsien (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 1 day.

(21) Appl. No.: 11/770,650

(22) Filed: Jun. 28, 2007

(51) Int. Cl.
*H01Q 1/24* (2006.01)

(52) U.S. Cl. ..... 343/702; 343/700 MS

(58) Field of Classification Search ..... 343/702, 343/700 MS, 829, 846
See application file for complete search history.

(56) References Cited

U.S. PATENT DOCUMENTS 6,040,806 A * 3/2000 Kushihi et al. ..... 343/853
6,433,745 B1 * 8/2002 Nagumo et al. ..... 343/700 MS
6,693,594 B2 * 2/2004 Pankinaho et al. .... 343/700 MS
7,053,844 B2 * 5/2006 Gaucher et al. ..... 343/702
7,091,911 B2 * 8/2006 Qi et al. ..... 343/702
2004/0090377 A1 * 5/2004 Dai et al. ..... 343/700 MS

* cited by examiner

*Primary Examiner*—Tho G Phan
(74) *Attorney, Agent, or Firm*—WPAT, P.C.; Anthony King

(57) ABSTRACT

An integrated multi-band antenna has a first radiating element and a second radiating element. The first radiating element has a first radiating conductor defining opposite sides connected to a second radiating conductor and a third radiating conductor respectively. A fourth radiating conductor defines a first end facing the free end of the third radiating conductor. A fifth radiating conductor connects the third radiating conductor and vicinity of the first end of the fourth radiating conductor. A sixth radiating conductor connects the first radiating conductor and close to a ground portion. The second radiating element has a seventh radiating conductor staggered opened plurality of slots at opposite sides thereon. An eighth radiating conductor connects the seventh radiating conductor and the ground portion. The integrated multi-band antenna operates at wireless telecommunication frequency through the first radiating element and operates at wireless local area network frequency through the second radiating element.

23 Claims, 4 Drawing Sheets

INTEGRATED MULTI-BAND ANTENNA

BACKGROUND OF THE INVENTION

1. Field of the Invention

The invention relates to an integrated multi-band antenna and more specifically, to an integrated multi-band antenna capable of operating at wireless telecommunication frequency and wireless local area network frequency.

2. The Related Art

According to the progress of the communication technology, the key development is the transfer from wired to wireless communication, such as the popularization of the wireless household phones, mobile phones and personal digital assistants. In the field of wireless communication, the signal is carriered through invisible electromagnetic wave. Therefore, the bridge between electrical signal and electromagnetic wave is an antenna. So the antenna is certainly needed by a wireless communication device to transmit or receive electromagnetic wave. The antenna is therefore an essential component in the wireless communication device.

Wireless communication bands contains telecommunication bands and wireless local area network bands. Telecommunication frequency include global system for mobile communications (GSM) band about 850 mega-hertz (MHz), extended global system for mobile communications (EGSM) band about 900 MHz, digital cellular system (DCS) band about 1800 MHz, personal conferencing specification (PCS) band about 1900 MHz, wideband code division multiple access (W-CDMA) band about 2100 MHz.

Wireless local area network bands include 2.4 giga-hertz (GHz) and 5.2 GHz nowadays. Therefore, an antenna capable of operating at telecommunication bands and wireless local area network bands being mentioned above is a necessary component for the portable electrical device.

SUMMARY OF THE INVENTION

An object of the present invention is to provide an integrated multi-band antenna capable of operating at wireless telecommunication frequency and wireless local area network frequency.

According to the invention, the integrated multi-band antenna includes a first radiating element and a second radiating element spaced from the first radiating element. The first radiating element and the second radiating element are arranged at a dielectric element. The first radiating element has a first radiating conductor, a second radiating conductor, a third radiating conductor, a fourth radiating conductor, a fifth radiating conductor and a sixth radiating conductor.

The first radiating conductor with a first feeding point defines opposite sides. The second radiating conductor and the third radiating conductor connect opposite sides of the first radiating conductor respectively. The fourth radiating conductor defines a first end facing the free end of the third radiating conductor. The fifth radiating conductor connects the third radiating conductor and vicinity of the first end of the fourth radiating conductor. The sixth radiating conductor connects the first radiating conductor and close to a ground portion.

The second radiating element has a seventh radiating conductor and an eighth radiating conductor. A plurality of slots staggered opened at opposite sides of the seventh radiating conductor. The eighth radiating conductor connects the seventh radiating conductor and the ground portion.

The first radiating element obtains frequency ranges corresponding to wireless telecommunication frequency and the second radiating conductor obtains frequency ranges corresponding to wireless local area network frequency. Therefore, the integrated multi-band antenna operates at wireless telecommunication frequency and wireless local area network frequency through the first radiating element and the second radiating element.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
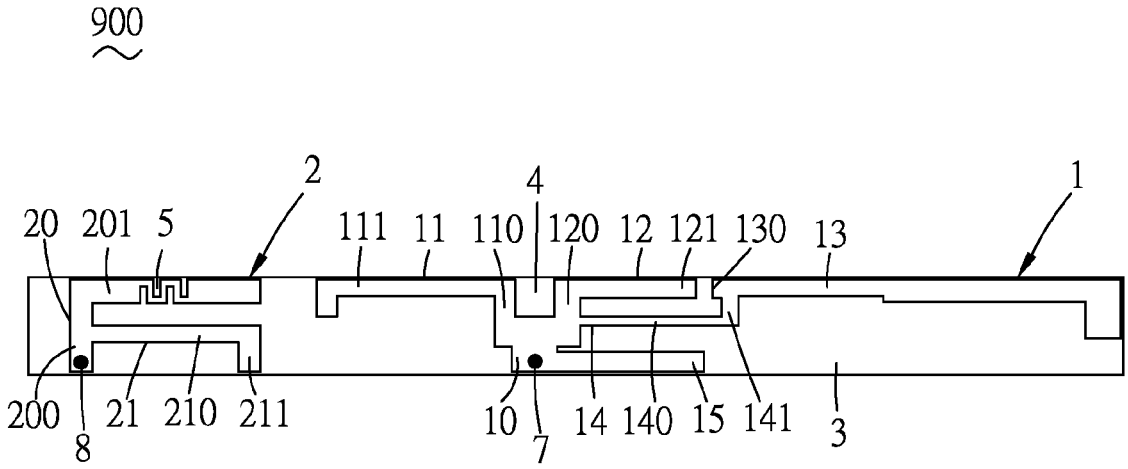
FIG. 1 shows a preferred embodiment of an integrated multi-band antenna according to the present invention.

Please refer to FIG. 1. A preferred embodiment of an integrated multi-band antenna 900 according to the present invention is shown. The integrated multi-band antenna 900 is arranged at a dielectric element 3. The integrated multi-band antenna 900 has a first radiating element 1 and a second radiating element 2 spaced from the first radiating element 1.

The first radiating element 1 has a first radiating conductor 10 defining opposite sides. A second radiating conductor 11 and a third radiating conductor 12 connect opposite sides of the first radiating conductor 10 respectively. In this case, the second radiating conductor 11 and the third radiating conductor 12 from as an elongated shape and extend to opposite directions.

The second radiating conductor 11 has a first section 110 and a second section 111 connecting the first section 110. The third radiating conductor 12 has a third section 120 and a fourth section 121 connecting the third section 120. The first section 110 of the second radiating conductor 11 and the third section 120 of the third radiating conductor 12 connect opposite sides of the first radiating conductor 10 respectively.

The second section 111 of the second radiating conductor 11 and the fourth section 121 of the third radiating conductor 12 extend to opposite directions. A hollow 4 is surrounded by the first radiating conductor 10, the first radiating conductor 110 of the second radiating conductor 11 and the third radiating section 120 of the second radiating conductor 12. The second section 111 of the second radiating conductor 11 forms as L-shape for downsizing issue.

A fourth radiating conductor 13 is arranged at same direction where the fourth section 121 of the third radiating conductor 12 extends to. In this case, the fourth radiating conductor 13 forms as an elongated shape defining a first end 130. The first end 130 of the fourth radiating conductor 13 faces to and spaces from the free end of the fourth section 121 of the third radiating conductor 12. The fourth radiating conductor 13 forms as L-shape for downsizing issue.

A fifth radiating conductor 14 connects the third radiating conductor 12 and the fourth radiating conductor 13. In this case, the fifth radiating conductor 14 forms as an elongated shape. The fifth radiating conductor 14 has a fifth section 140 and a sixth section 141 connecting the fifth section 140. The fifth section 140 of the fifth radiating conductor 14 is connected to the third section 120 of the third radiating conductor 12 and spaced from the fourth section 121 of the third radiating conductor 12.

In this case, the fifth section 140 of the fifth radiating conductor 14 parallels the third section 120 of the third radiating conductor 12. The sixth section 141 of the fifth radiating conductor 14 connects vicinity of the first end 130 of the fourth radiating conductor 13.

A sixth radiating conductor 15 connects one side of the first radiating conductor 10. In this case, the sixth radiating conductor 15 and the fifth section 140 of the fifth radiating conductor 14 are side by side. The sixth radiating conductor 15 parallels the fifth section 140 of the fifth radiating conductor 14.

The second radiating element 2 has a seventh radiating conductor 20. The seventh radiating conductor 20 has a seventh section 200 and an eighth section 201 connecting the seventh section 200. In this case, the seventh radiating conductor 20 forms as an elongated shape. The seventh section 200 connects the eighth section 201 to form as L-shape. Plurality of slots 5 are opened at opposite sides of the eighth section 201 of the seventh radiating conductor 20. The slots 5 opened at one side of the eighth section 201 and the slots 5 opened at the other side of the eighth section 201 are staggered.

A eighth radiating conductor 21 connects the seventh section 200 of the seventh radiating conductor 20. The eighth radiating conductor 21 has a ninth section 210 and a tenth section 211 connecting the ninth section 210. The ninth section 210 of the eighth radiating conductor 21 and the eighth section 201 of the seventh radiating conductor 200 are side by side. In this case, the eighth radiating conductor 21 forms as an elongated shape. The ninth section 210 of the eighth radiating conductor 21 parallels the eighth section 201 of the seventh radiating conductor 200.

Figure 2:
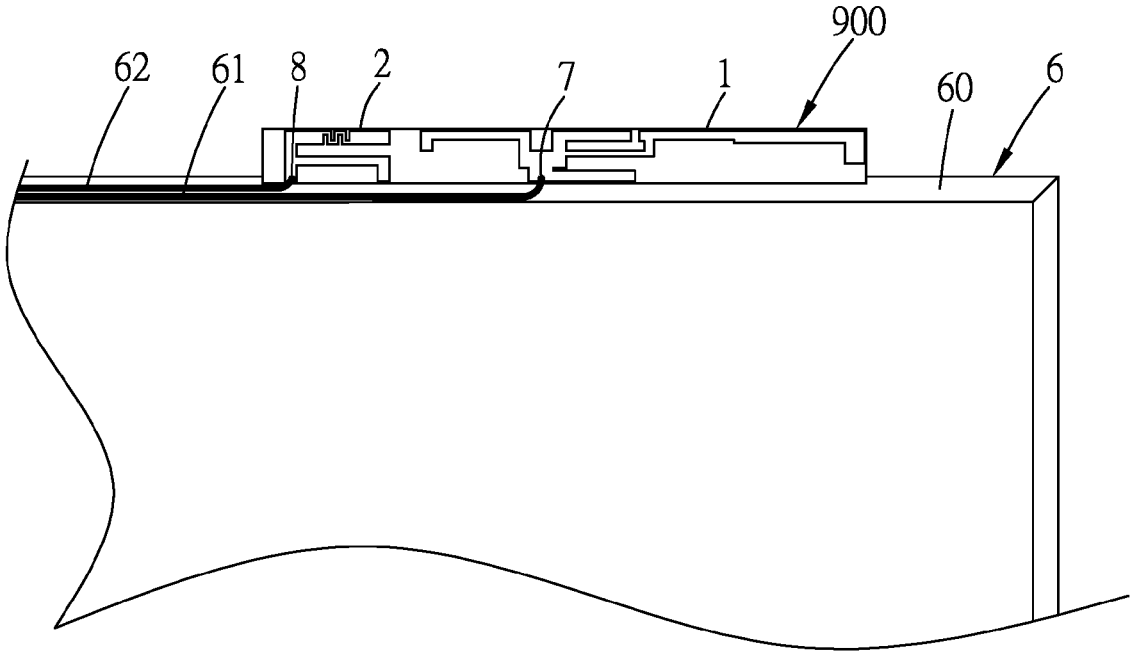
FIG. 2 is a perspective view showing the integrated multi-band antenna configure in top of a display of a laptop according to the present invention.

Please refer to FIG. 2. The integrated multi-band antenna 900 is configured in an electric device, especially configured in a laptop 6. In this case, the integrated multi-band antenna 900 is arranged at top of a display shielding 60 of the laptop 6. In this case, the display shielding 60 of the laptop 6 as ground portion of the integrated multi-band antenna 900. The sixth radiating conductor 15 of the first radiating element 1 is close to the ground portion.

The ninth section 210 of the eighth radiating conductor 21 of the second radiating element 2 is spaced from the ground portion and the tenth section 211 of the eighth radiating conductor 21 of the second radiating element 2 connects the ground portion. Therefore, the arrangement of the sixth radiating conductor 15 of the first radiating element 1 and the ground portion inducts a capacitance capable of instead of the matching circuit. Arrangement of the eighth radiating conductor 21 of the second radiating element 2 and the ground portion inducts an inductance capable of instead of the matching circuit.

Please refer to FIG. 1 and FIG. 2. The first radiating element 1 and the second radiating element 2 of the integrated multi-band antenna 900 connect a first wireless module and a second wireless module (not shown in figures) of the laptop 6 through a first cable 61 and a second cable 62 respectively. A first feeding point 7 is arranged at the first radiating conductor 10 of the first radiating element 1 and close to the ground portion. A second feeding point 8 is arranged at the seventh section 200 of the seventh radiating conductor 20 of the second radiating element 2 and close to the ground portion. One end of the first cable 61 connects the first feeding point 7 and the other end of the first cable 61 connects the first wireless module. One end of the second cable 62 connects the second feeding point 8 and the other end of the second cable 62 connects the second wireless module.

In this case, the capacitance inducted by the arrangement of the sixth radiating conductor 15 of the first radiating element 1 and the ground portion is tunable by tuning the length and the width of the sixth radiating conductor 15, and the distance between the sixth radiating conductor 15 and the ground portion. Also, the inductance inducted by arrangement of the eighth radiating conductor 21 of the second radiating element 2 and the ground portion is tunable by tuning the length and the width of the eighth conductor 21, and the distance between the tenth section 211 of the eighth radiating conductor 21 and the ground portion.

Figure 3:
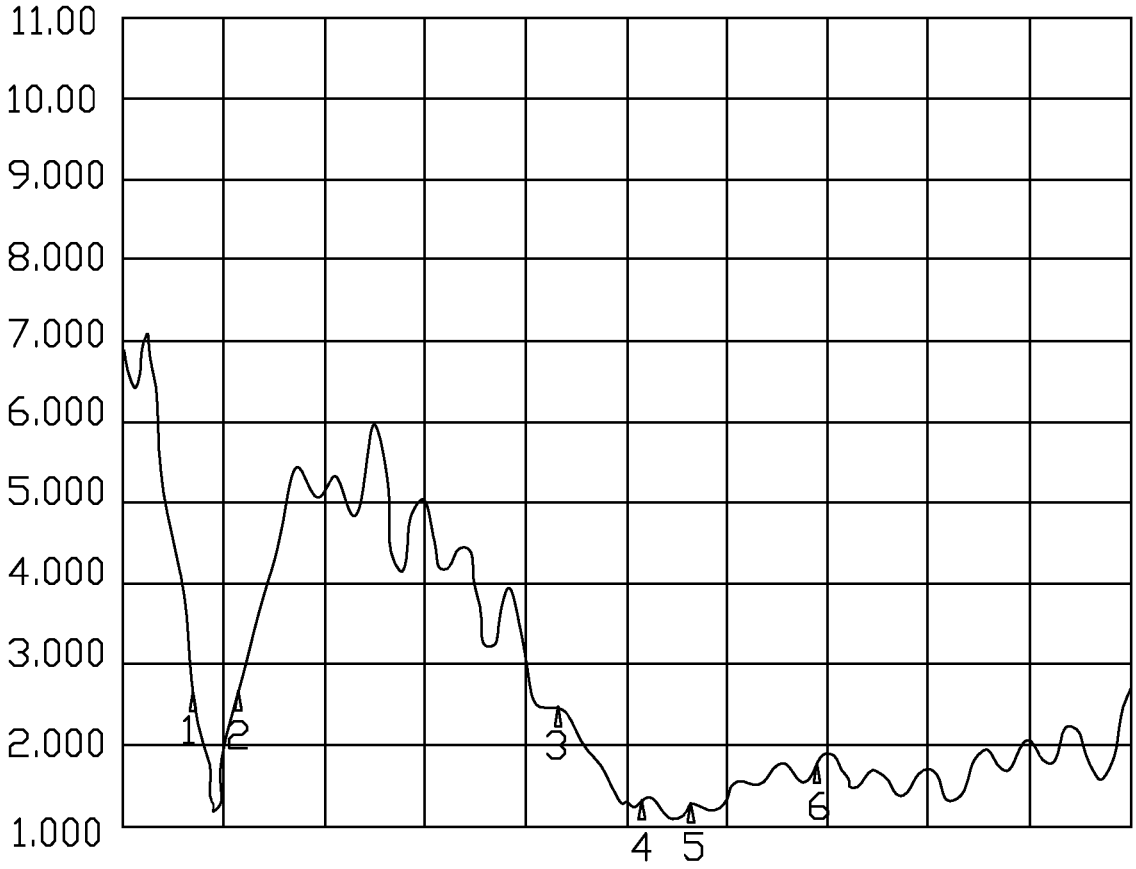
FIG. 3 shows a Voltage Standing Wave Ratio (VSWR) test chart of a first radiating element of the integrated multi-band antenna according to the present invention.

Please refer to FIG. 1 and FIG. 3. The first radiating conductor 10 and the second radiating conductor 11 of the first radiating element 1 obtain an electrical resonance corresponding to a quarter wavelength corresponding to a first band covering between approximately 1700 MHz and approximately 2000 MHz. The first radiating conductor 10, the third section 120 of the third radiating conductor 12, the fourth radiating conductor 13 and the fifth radiating conductor 14 of the first radiating element 1 obtain an electrical resonance corresponding to a quarter wavelength corresponding to a second band covering between approximately 800 MHz and approximately 1000 MHz. The first radiating conductor 10 and the third radiating conductor 12 of the first radiating element 1 obtain an electrical resonance below a quarter wavelength corresponding to a third band covering between approximately 2000 MHz and approximately 2200 MHz.

In this case, the first radiating conductor 10 and the second radiating conductor 11 of the first radiating element 1 are tunable to corresponding to the first band. The first radiating conductor 10, the fourth radiating conductor 13 and the fifth radiating conductor 14 of the first radiating element 1 are tunable to corresponding to the second band. The first radiating conductor 10 and the third radiating conductor 12 of the first radiating element 1 are tunable to corresponding to the third band.

The hollow 4 of the first radiating element 1 is tunable to corresponding to impedance of the first radiating element 1, and the first band and the third band. In this case, the arrangement of the free end of the third radiating conductor 12 and the first end 130 of the fourth radiating conductor 13 inducts a capacitance substantially tunable to corresponding to the third band.

Therefore, the capacitance inducted by the arrangement of the third radiating conductor 12 of the fourth radiating element 13 is tunable by tuning the length and the width of the third radiating conductor 12 and the fourth radiating conductor 13, and the distance between the free end of the third radiating conductor 12 and the first end 130 of the fourth radiating conductor 13. In this case, the distance between the fourth section 121 of the third radiating conductor 12 and the fifth section 140 of the fifth radiating conductor 14 is tunable to corresponding to the second band and the third band.

Figure 4:
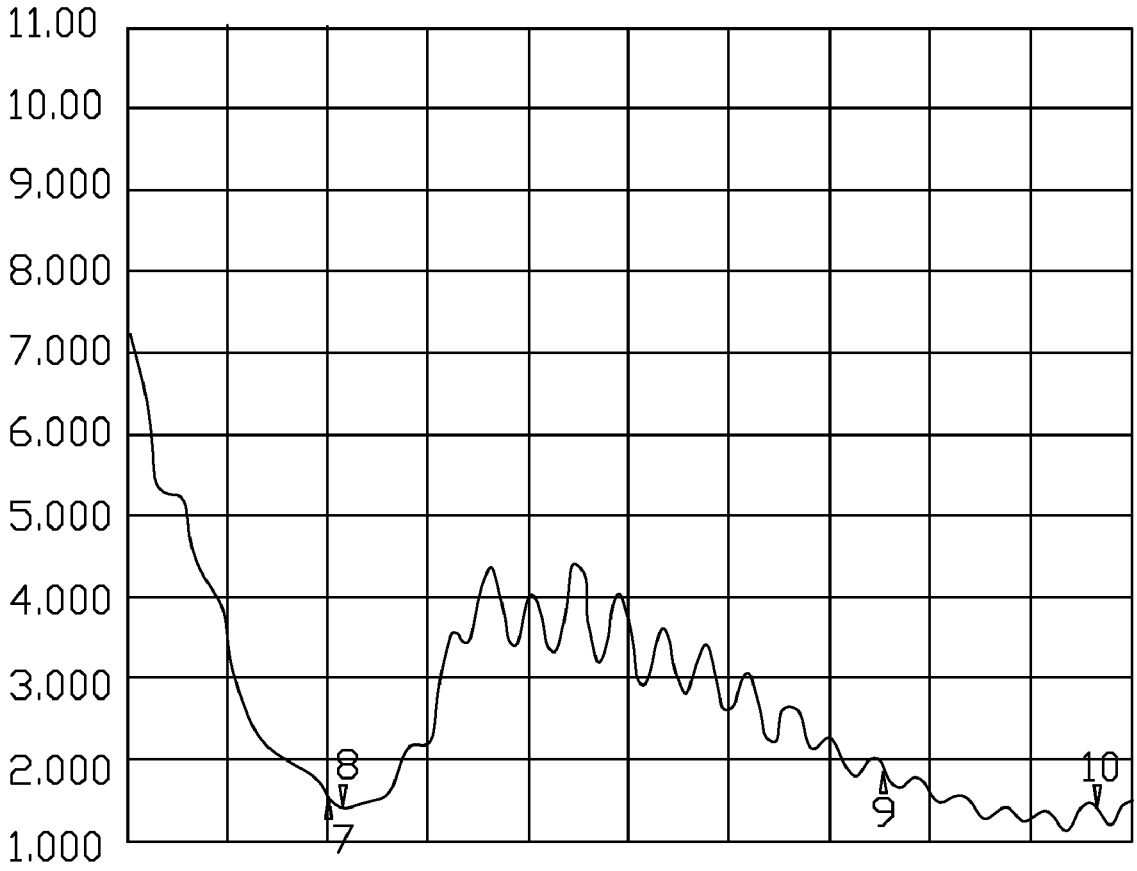
FIG. 4 shows a Voltage Standing Wave Ratio (VSWR) test chart of a second radiating element of the integrated multi-band antenna according to the present invention.

Please refer to FIG. 1 and FIG. 4. The seven radiating conductor 20 and the eighth radiating conductor 21 of the second radiating element 2 obtain an electrical resonance corresponding to a quarter wavelength corresponding to a fourth band covering 2.4 GHz. The seven radiating conductor 20 and the eighth radiating conductor 21 of the second radiating element 2 further obtain a homonymic frequency corresponding to a fifth band covering 5.2 GHz In this case, the slots 5 opened at the eighth section 201 of the seventh radiating conductor 20 of the second radiating element 2 is tunable to corresponding to the fourth band. The distance between the eighth section 201 of the seventh radiating conductor 20 and the ninth section 210 of the eighth conductor 21 is tunable to corresponding to the fourth band and the fifth band. In this case, the free end of the eighth 201 of the seventh radiating conductor 20 of the second radiating element 2 faces to the second radiating conductor 11 of the first radiating element 1 for improving the bands of the first radiating element 1 and the second radiating element 2.

Please refer to FIG. 3 and FIG. 4. FIG. 3 showing a Voltage Standing Wave Ratio (VSWR) test chart of a first radiating element 1 of the integrated multi-band antenna 900. When the integrated multi-band antenna 900 operates at 824 MHz, 960 MHz, 1710 MHz, 1880 MHz, 1990 MHz and 2170 MHz, the VSWR value are below 3. FIG. 4 showing a Voltage Standing Wave Ratio (VSWR) test chart of a second radiating element 2 of the integrated multi-band antenna 900. When the integrated multi-band antenna 900 operates at 2.41 GHz, 2.46 GHz, 4.9 GHz and 5.8 GHz, the VSWR value are below 2.

The capacitance inducted by the arrangement of the sixth radiating conductor 15 of the first radiating element 1 and the ground portion instead of the matching circuit for cost down issue. Furthermore, the inductance inducted by the arrangement of the eighth radiating conductor 21 of the second radiating element 2 and the ground instead of the matching circuit for cost down issue. The capacitance inducted by the arrangement of the third radiating 12 and the fourth radiating conductor 13 of the first radiating element 1 instead of a trap circuit for cost down issue.

The integrated multi-band antenna 900 obtains the first band between approximately 1700 MHz and approximately 2000 MHz, the second band between approximately 800 MHz and approximately 1000 MHz and the third band between approximately 2000 MHz and approximately 2200 MHz corresponding to wireless telecommunication frequency through the arrangement of the first radiating element 1. The integrated multi-band antenna further obtains the fourth band covering 2.4 GHz and the fifth band covering 5.2 GHz corresponding to wireless local area network frequency through the arrangement of the first radiating element 2.

Furthermore, the present invention is not limited to the embodiments described above; various additions, alterations and the like may be made within the scope of the present invention by a person skilled in the art. For example, respective embodiments may be appropriately combined.

What is claimed is:

1. An integrated multi-band antenna comprising:

a ground portion;

a first radiating conductor having a first feeding point close to said ground portion and defining opposite sides;

a second radiating conductor and a third radiating conductor connected to opposite sides of said first radiating conductor respectively;

a fourth radiating conductor defining a first end facing to the free end of said third radiating conductor;

a fifth radiating conductor connected to said third radiating conductor and vicinity of said first end of said fourth radiating conductor;

a sixth radiating conductor connected to said first radiating conductor and close to said ground portion;

a seventh radiating conductor staggered opened plurality of slots at opposite sides thereon and having a second feeding point close to said ground portion;

an eighth radiating conductor, connected to said seventh radiating conductor and said ground portion.

2. The integrated multi-band antenna as claimed in claim 1, wherein said second radiating conductor has a first section and a second section connected to said first section, said third radiating conductor having a third section and a fourth section, said first section and said third section connected to opposite sides of said first radiating conductor respectively, said second section and said fourth section extended to opposite directions, said free end of said fourth section faced to said first end of said fourth radiating conductor.

3. The integrated multi-band antenna claimed in claim 2, wherein said first, second and third radiating conductors substantially tunable in frequency ranges covering between approximately 1700 MHz and approximately 2200 MHz, said first radiating conductor, said third section of said third radiating conductor, said fourth radiating conductor and said fifth radiating conductor substantially tunable in frequency ranges covering between approximately 800 MHz and approximately 1000 MHz.

4. The integrated multi-band antenna claimed in claim 3, wherein the arrangement of said free end of said fourth section of said third radiating conductor and said first end of said fourth radiating conductor inducts a capacitance.

5. The integrated multi-band antenna claimed in claim 3, wherein the arrangement of said free end of said fourth section of said third radiating conductor and said first end of said fourth radiating conductor is substantially tunable in frequency ranges covering between approximately 2000 MHz and approximately 2200 MHz.

6. The integrated multi-band antenna claimed in claim 3, wherein the arrangement of said first radiating conductor, said first section of said second radiating conductor and said third section of said third radiating conductor forms a hollow.

7. The integrated multi-band antenna claimed in claim 6, wherein said hollow is tunable to corresponding to the impedance of said integrated multi-band antenna.

8. The integrated multi-band antenna claimed in claim 3, wherein said fifth radiating conductor has a fifth section and a sixth section connected to said fifth section, said fifth section connected to said third section of said third radiating conductor, said sixth section connected to vicinity of said first end of said fourth radiating conductor.

9. The integrated multi-band antenna as claimed in claim 8, wherein the arrangement of said fifth section of said fifth radiating conductor and said fourth section of said third radiating conductor is substantially tunable in frequency ranges covering between approximately 2000 MHz and approximately 2200 MHz and in frequency ranges covering between approximately 800 MHz and approximately 1000 MHz.

10. The integrated multi-band antenna as claimed in claim 8, wherein said fourth section of said third radiating conductor and said fifth section of said fifth radiating conductor are side by side.

11. The integrated multi-band antenna as claimed in claim 8, wherein said sixth radiating conductor and said fifth section of said fifth radiating conductor are side by side.

12. The integrated multi-band antenna as claimed in claim 2, wherein said second section of said second radiating conductor forms as L-shape.

13. The integrated multi-band antenna as claimed in claim 1, wherein the arrangement of said sixth radiating conductor and said ground portion inducts a capacitance.

14. The integrated multi-band antenna as claimed in claim 1, wherein said fourth radiating conductor forms as L-shape.

15. The integrated multi-band antenna as claimed in claim 1, wherein said seventh radiating conductor with said slots is substantially tunable in frequency ranges covering approximately 2.4 GHz and approximately 5.2 GHz.

16. The integrated multi-band antenna as claimed in claim 15, wherein said seventh radiating conductor has a seventh section with said second feeding point and an eighth section connected to said seventh section, said slots opened at opposite sides of said eighth section.

17. The integrated multi-band antenna as claimed in claim 16, wherein said seventh section connects said eighth section to form as L-shape.

18. The integrated multi-band antenna as claimed in claim 16, wherein said eighth radiating conductor has a ninth section and a tenth section connected to said ninth section, said ninth section connected to said seventh section and said tenth section connected to said ground portion.

19. The integrated multi-band antenna as claimed in claim 18, wherein said eighth section of said seventh radiating conductor and said ninth section of said eighth radiating conductor are side by side.

20. The integrated multi-band antenna as claimed in claim 16, wherein the free end of said eighth section of said seventh radiating conductor faces to said second section of said second radiating conductor.

21. The integrated multi-band antenna as claimed in claim 1, wherein the arrangement of said eighth radiating conductor and said ground portion inducts a capacitance.

22. The integrated multi-band antenna as claimed in claim 1, wherein said first radiating conductor, said second radiating conductor, said third radiating conductor, said fourth radiating conductor, said fifth radiating conductor, said sixth radiating conductor, said seventh radiating conductor and said eighth radiating conductor are arranged at a dielectric element.

23. The integrated multi-band antenna as claimed in claim 1, wherein said integrated multi-band antenna is configured in top of a display shielding of a laptop.

* * * * *